United States Patent [19]

Foerster

[11] 4,221,372

[45] Sep. 9, 1980

[54] MACHINE FOR COLLATING SHEET MATERIAL

[76] Inventor: Peter H. Foerster, 37-27 Crescent St., Long Island City, N.Y. 11101

[21] Appl. No.: 930,320

[22] Filed: Aug. 2, 1978

[51] Int. Cl.[2] ..... B65H 39/055

[52] U.S. Cl. ..... 270/58

[58] Field of Search ..... 270/58

[56] References Cited

U.S. PATENT DOCUMENTS

| | | | |
|---|---|---|---|
| 3,175,821 | 3/1965 | Gibson | 270/58 |
| 3,559,982 | 2/1971 | Eppers | 270/58 |
| 4,053,149 | 10/1977 | Paulus | 270/58 |

*Primary Examiner*—Edgar S. Burr
*Assistant Examiner*—A. Heinz

[57] ABSTRACT

Collating machine comprising a plurality of spaced trays each supporting identical sheets, a conveyor moving under the trays, a feeding device adjacent each tray for pulling out a sheet therefrom and depositing it onto the conveyor and including an electrically actuated clutch, a transmission device adapted to be cyclically engaged with the clutch, a first switch downstream relative to travel of the conveyor from each tray for supplying current to disengage the clutch upstream therefrom in response to a sheet fed from the tray immediately upstream thereof, a second switch upstream from all except the first tray for supplying current to engage the clutch immediately downstream therefrom in response to a sheet fed from the tray immediately upstream therefrom, a common power shaft supplying power to the transmission device, an electrically actuated system clutch for connecting the shaft to the transmission device and conveyor for normal operation of the machine and disconnecting the shaft from the conveyor during malfunction of the machine, electrically actuated brake for stopping the conveyor, and control arrangement including cams and switches for supplying current to engage the clutch of the first feeding device to initiate one or more operational cycles of the machine and to disengage the system clutch and engage the brake upon failure of a sheet to be fed past a first switch downstream from one of the trays to disengage the clutch of its feeding device.

21 Claims, 12 Drawing Figures

FIG. 7.
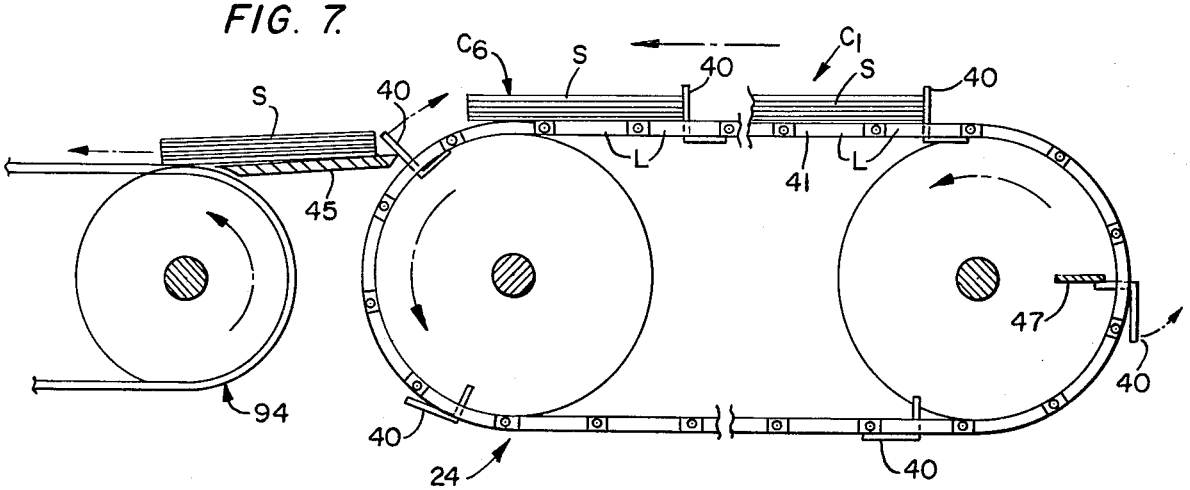
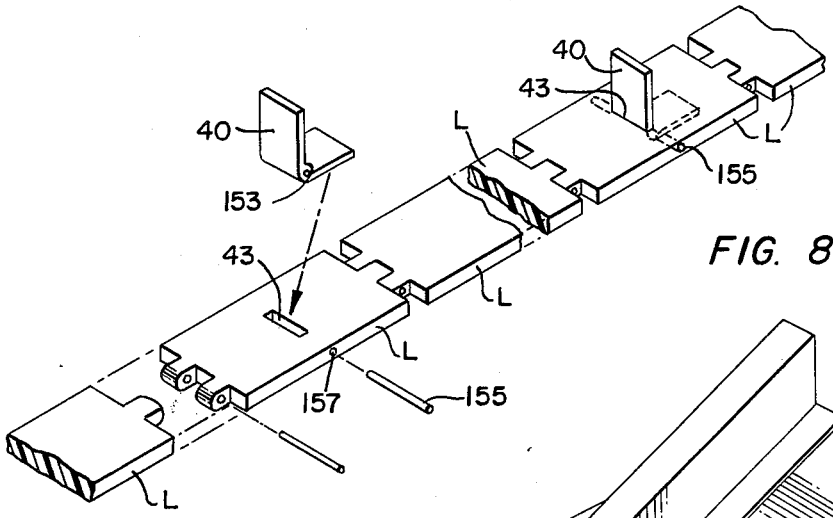
FIG. 8.
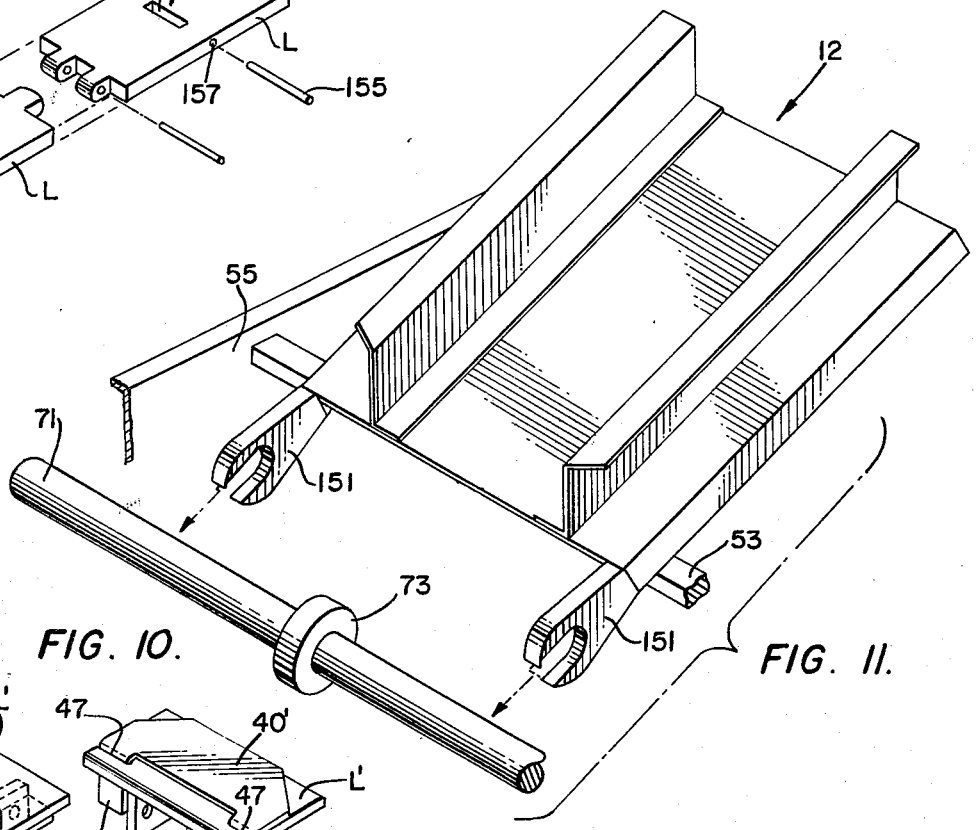
FIG. 11.
FIG. 9.
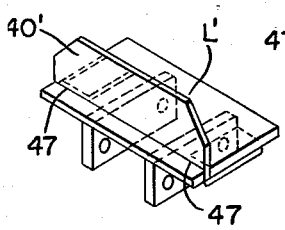
FIG. 10.
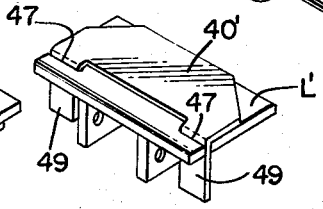

MACHINE FOR COLLATING SHEET MATERIAL

BACKGROUND OF THE INVENTION

1. Field of the Invention

The present invention relates to a new and improved machine with which one may collate sheet material from each of a plurality of individual groups of sheet material to form a set or a plurality of sets including one sheet from each of the groups. More particularly, the present invention provides a machine whereby one may collate sheet material to form sets, each of which includes at least and only one sheet from each of a plurality of individual groups.

2. Description of the Prior Art

The known prior art machines of the class to which the present invention appertains includes a number of patents relating to collating machines comprising a plurality of feed stations including means for sensing defective feeding at any given feed station and deactivating feeding downstream therefrom, as exemplified by U.S. Pat. No. 3,656,738 of Glaser et al and U.S. Pat. No. 3,825,246 of Elia et al.

Other known prior art of interest includes U.S. Pat. No. 3,559,982 of Eppers, which relates to a collating machine relying upon photoelectric-sensing means to sense feeding more than one sheet of material at any one station in any cycle and a spring contact slide device to sense the absence of a sheet fed during a cycle, of which either sensed condition will effect shutting down the machine. While the Eppers machine may appear neat in theory, operability thereof does not appear to be entirely clear.

SUMMARY OF THE INVENTION

With the background of the present invention as generally outlined above, applicant has developed a new and improved machine for collating sheet material from a plurality of individual groups to form one or more sets, each of which is to include one sheet from each of the groups.

Accordingly, it is an object of the present invention to provide a machine for combining a given number of sheet material, pages or the like from each of a plurality of different groups of sheet material, pages or the like in an orderly fashion.

It is also an object of this invention to provide a mechanized system for collating sheet material, pages or the like to form a plurality of sets in rapid order.

It is further an object of this invention to provide a machine for collating sheet material, pages or the like whereby all sets collated thereon will include only one sheet or page from each group of sheets or pages.

It is yet another object of this invention to provide a machine for collating material whereby at least one sheet or page from each group of sheets or pages is included in each set of sheets or pages collated thereon.

It is still another object of this invention to provide a collating machine whereby the omission of a sheet from any supply group or the tendency to include duplicate sheets from any supply group in a set being collated is immediately sensed and correction thereof is readily attainable.

Yet another object of the present invention is to provide a collating machine whereby the number of sheets to be collated into a set may be increased or decreased within practical limits.

To attain the above objectives according to the present invention, one embodiment thereof comprises a plurality of spaced-apart trays supported at an incline or slant with respect to the horizontal, of which each tray is adapted to hold and dispense identical sheets of material of different groups of such material; an endless collating conveyor passing under the trays; and an individual feeder mechanism associated with each of the trays for sequentially feeding a single sheet from each of the trays to the collating conveyor to continuously form sets of sheets from all groups. Each feeder mechanism includes a rotatable friction pull-out roller for pulling out a sheet from a tray associated therewith and feeding downwardly to the collating conveyor passing thereunder. The collating conveyor is provided with longitudinally spaced-apart abutment members defining compartments into which sheets may be dispensed. Each compartment in operation is adapted to receive one sheet from each tray to form a set. The collating conveyor is in the form of an endless chain so that each compartment will cyclically pass under the various trays to receive sets of sheet material as in the formation of a book. Automated and mechanized operation of the present invention is effected by individual drive rollers in frictional drive relationship with each of the pull-out rollers. A common power shaft is provided to drive the collating conveyor and the individual drive rollers. Drive is effected from the power shaft by one or more wheels, which may be in the form of sprocket wheels, keyed or otherwise secured to the power shaft and in driving engagement with the collating conveyor. Also secured to the power shaft and axially spaced away from the sprocket wheels is an input wheel or sprocket in driving relationship with a drive chain or the like which is in turn in driving relationship with a plurality of output sprocket wheels or the like. The output sprocket wheels are each operably associated with a drive shaft on which a drive roller is secured. Disposed between each output sprocket wheel and the drive shaft associated therewith is a clutch. Each drive roller as mentioned above is in frictional drive relationship with a pull-out roller. Spaced apart from the power shaft is an additional shaft having one or more wheels secured thereto and over which the collating conveyor is rotatably supported. Operational condition control means in the form of rotating cams are provided on one end of the additional shaft rotatably supporting the collating conveyor. A system brake is also provided for braking the collating conveyor in response to a particular condition of operation. The power shaft comprises separable portions and obtains its drive from the output of a drive motor through a system clutch which is adapted to connect and disconnect the separable portions thereof. A first portion of the power shaft has the input wheel or sprocket secured thereon and the second portion, separable from the first portion, has the collating conveyor drive wheels secured thereon. Also secured to the first portion of the power shaft are an output drive wheel of a motor and drive arrangement and an input drive wheel for an output conveyor unit. Operational conditions of the disclosed system are sensed by an arrangement of microswitches strategically located along the collating conveyor and a plurality of cam members adjustably positioned and secured on one end of the additional shaft over which the collating conveyor shaft is rotatably supported. The cam members are located in different axial positions along and in different circumferential positions around the shaft on which they are secured and periodically contact various switches during rotation to effect various operations with a control circuit the purpose of which will be described hereinbelow.

BRIEF DESCRIPTION OF THE DRAWINGS

In the drawings which are presented for illustrative purposes:

FIG. 7 a side elevational view on an enlarged scale with portions broken away due to space limitations operational details in transferring collating sheets between a primary or collating conveyor and a secondary conveyor;

FIG. 8 shows a partially exploded view in perspective of one portion of the collating conveyor belt of the disclosed machine;

FIG. 9 shows an alternative link form for the belt of FIG. 8;

FIG. 10 shows the link of FIG. 9 with the spacer member folded out of operational position;

FIG. 11 shows an exploded view in perspective of a tray and support shaft to be assembled for use in the disclosed machine.

DETAILED DESCRIPTION OF THE INVENTION

Figure 5:
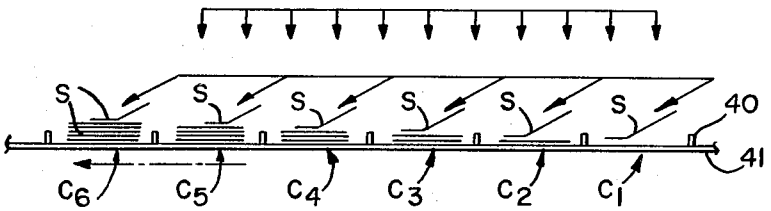
FIG. 5 is an outline depicting generally the rate and sequence sheets may be collated at various stations by the present invention.

Upon carefully studying the above drawings and reading the specification, the reader will readily appreciate that the subject matter of the invention relates to a machine 10 for rapidly and accurately collating sheet material from a plurality of individual groups to form sets including one sheet from each of the groups. The machine 10, as may be seen in FIGS. 1–4, comprises a plurality of spaced-apart trays 12, 14, 16, 18, 20, 22 supported at an incline or slant with respect to the horizontal, of which each tray is adapted to hold and dispense identical sheets S of material of different groups of such material; an endless collating conveyor 24 passing under the trays 18–22; and an individual feeder mechanism 26, 28, 30, 32, 34, 36 associated with each of the trays 18–22 for sequentially feeding a single sheet S from each of the trays 18–22 to the collating conveyor 24 to continuously form sets of sheets from all groups as depicted in FIG. 5. Each feeder mechanism 26–36 includes a rotatable friction wheel 42 and pull-out roller 38 for pulling out a sheet S from a tray 12, 14, 16, 18, 20 or 22 associated therewith and feeding downwardly to the collating conveyor 24 passing thereunder. The collating conveyor 24 is provided with longitudinally spaced-apart abutment members 40 defining compartments $C_1$, $C_2$, $C_3$, $C_4$, $C_5$, $C_6$, etc., into which sheets S may be dispensed. Each compartment $C_1$, $C_2$, etc., in operation is adapted to receive one sheet S from each tray 12–22 to form a set. The collating conveyor 24 is in the form of an endless belt or chain 41 so that each compartment $C_1$, $C_2$, etc., will cyclically pass under the various trays 12–22 to receive sets of sheet material as in the formation of a book. Individual drive wheels 42 are disposed in frictional drive relationship with each of the pull-out rollers 38 and may be drivingly engaged with or disengaged from drive through individual clutch units 44, 46, 48, 50, 52, 54. A two-piece power shaft 56 having wheels hidden from view on a first portion 58, keyed or otherwise secured thereon, supplies power to drive collating conveyor 24. Also secured to power shaft 56 on a second portion 60 and axially spaced away from the hidden wheels is an input wheel or sprocket 62 in driving relationship with a drive chain 64 or the like which is in turn in driving relationship with a plurality of output sprocket wheels 66, 68, 70, 72, 74, 76, or the like for driving pull-out rollers 38 through the hub portion of the clutch unit associated therewith. When the hub of each clutch unit 44, 46, 48, 50, 52, or 54 are engaged, power is provided to friction feed wheel 42 and its shaft. While chain 64 continuously drives sprockets 66–76, power to individual pull-out rollers 38 and drive wheels 42 is effected through the clutches 44–54. Each drive wheel 42 as mentioned above is in frictional drive relationship with a pull-out roller 38. Second shaft portion 60 of power shaft 56 is controlled by a system clutch 78 for engagement with first shaft portion 58 for conditioning the collating conveyor to be driven or to be idle. The clutch units 44–54 may be of conventional construction.

Figure 2:
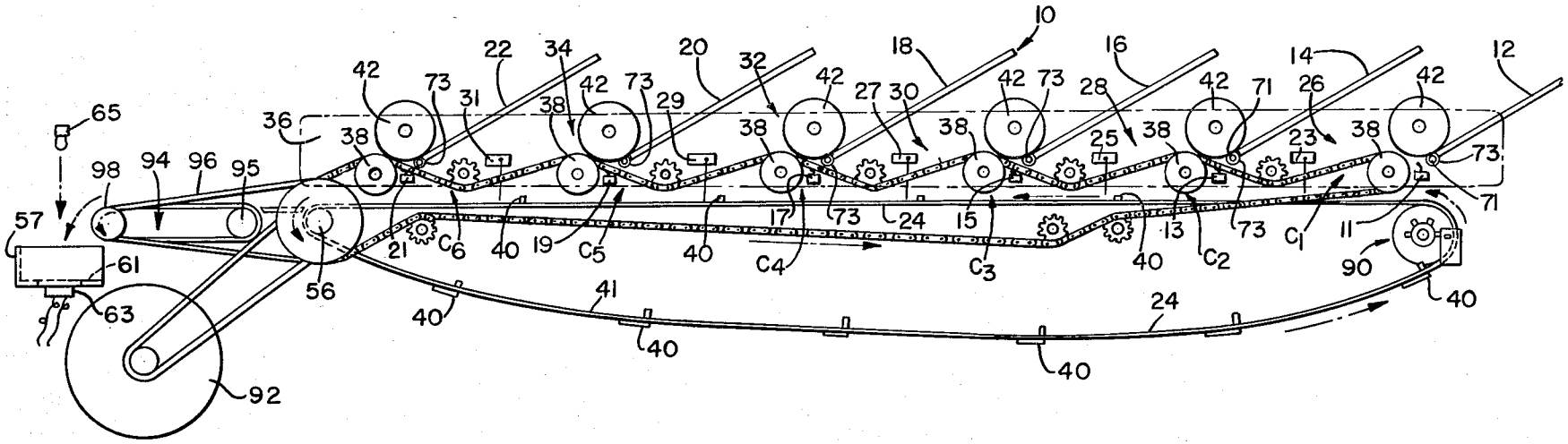
FIG. 2 is a side elevation of the machine looking from the lower side of FIG. 1 toward the upper side.
Figure 3:
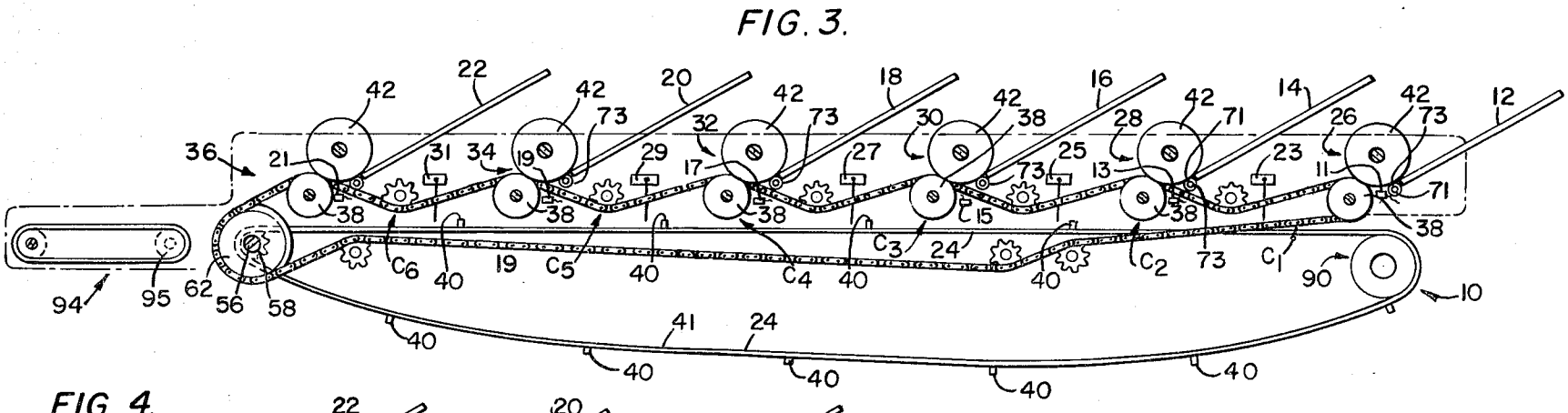
FIG. 3 is a view taken along the line 3—3 in FIG. 1.
Figure 6:
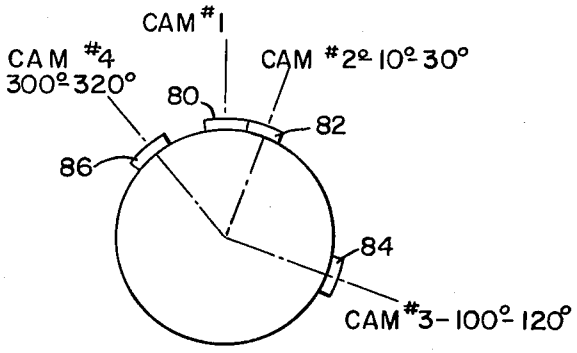
FIG. 6 shows on an enlarged scale the position of various cams on a shaft member for effecting controlled operation of the machine according to the invention.
Figure 4:
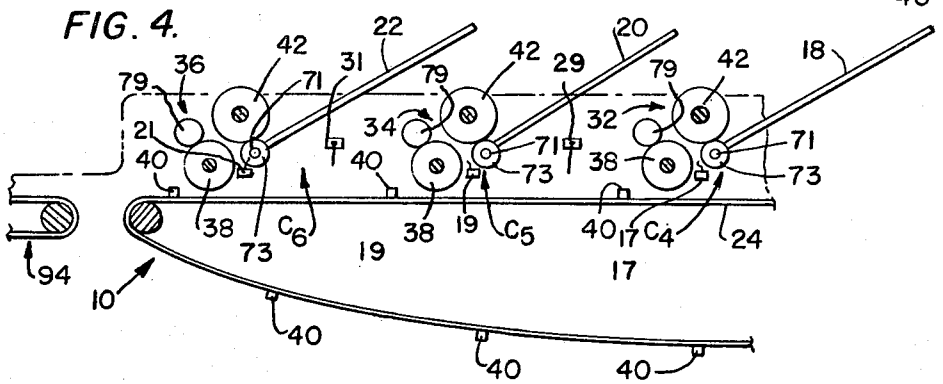
FIG. 4 is a view taken along the line 4—4 in FIG. 1.

Conveyor belt 41 as illustrated in FIGS. 7 and 8 on an enlarged scale from that of FIG. 2 is seen to be of the link type which comprises a plurality of links L some of which are provided with spacer members 40 each of which is in the form of an L-shape plate with a portion including eyelet means 153 disposed in a slot 43. Each spacer member 40 is then secured in slot 43 by a retaining-pivot pin 155 inserted through a hole 157 in alignment with slot 43 and eyelet means 153 so that it will not fall or become dislodged therefrom. The spacer members 40 are not provided in every link L of conveyor belt 41, but are provided in links L with several other links L thereafter without spacer member 40 so as to delineate compartments $C_1$, $C_2$, $C_3$, etc., for paper to be deposited upon the conveyor 24. At the downstream end of conveyor 24 is a plate 45 against which the radially outer portion of each spacer element 40 collides as belt 41 passes through a transition path from upper run to lower run so that the radial outer portion will be deflected in a clockwise direction and will not catch or tear collated sheets S which it trails as the sheets S are transferred to secondary conveyor 94. As each conveyor belt link L with a spacer member 40 approaches the upper run at the upstream end of the conveyor 24 the radial inner portion of spacer member 40 strikes a second plate 47 which deflects the spacer member 40 in the counterclockwise direction so that the outer portion thereof will again delineate an effective compartment $C_1$, $C_2$, $C_3$, etc. The links L of conveyor belt 41 are hingedly connected by pivot pins as is customary.

Instead of the link and spacer forms illustrated in FIGS. 7 and 8, links L′ and spacer members 40′ as illustrated in FIGS. 9 and 10 may be used to form an alternative form of conveyor belt wherein each link L′ is formed with laterally spaced laterally extending slits 47 through which spaced-apart tabs 49 formed in spacer member 40′ and bent at right angle extend. In FIG. 9 the spacer member 40′ is in an upright position to delineate a compartment while in FIG. 10 the spacer member 40' has been deflected into an idle position.

Operational condition control means in the form of rotating cams 80, 82, 84, 88 are provided on one end of the additional shaft 88 rotatably supporting the collating conveyor 24. A system brake 90 is also provided for braking the collating conveyor 24 in response to a particular condition of operation. The power shaft 56, which comprises separable portions 58, 60, obtains its drive from the output of a drive motor 92 through a system clutch 78 which is adapted to connect and disconnect the separable portions 58, 60 thereof. The first portion 58 of the power shaft 56 has the input wheel or sprocket 62 secured thereon and the second portion 60, separable from the first portion 58, has the collating conveyor drive wheels secured thereon. Operational conditions of the disclosed system are sensed by an arrangement of microswitches strategically located along the collating conveyor 24 and a plurality of cams 80–86 adjustably positioned and secured on one end of the additional shaft 88 over which the collating conveyor 24 is rotatably supported. The high spots of cams 80–86 are located in different axial positions along and in different circumferential positions around the shaft 88 on which they are secured and periodically contact various switches during rotation to effect various operations with a control circuit the purpose of which will be described hereinbelow.

Drive motor 92 also supplies power for driving a secondary conveyor 94 by way of a sprocket 95 secured to first shaft portion 58 of power shaft 56, chain 96, and sprocket 98 secured to a shaft 99 associated with secondary conveyor 94.

Each of the trays 12, 14, 16, 18, 20, 22 is removably supported on an underlying rod 53 or the like extending from a stationary frame portion 55, as illustrated in FIG. 11, and further includes a pair of laterally spaced-apart slotted claws 151 which are adapted to be slid partially over a shaft 71 and be additionally supported thereby. A paper separator 73 is fixed on shaft 71 for rotation therewith, which shaft 71 is rotatable within slotted claws 151. It is thus clear from FIG. 11 that each tray 12, 14, 16, etc. may be readily removed from rod 53 and shaft 71 for maintenance and thereafter reassembled without special tools.

To collect the collated sets of material, a bin 57 is situated below the downstream end of secondary conveyor 94 as may be seen in FIGS. 1 and 2. Bin 57 has a hole 59 in the bottom 61 thereof which hole 59 facilitates removal of collated sets of material deposited therein by allowing an attendant to insert a hand therethrough from beneath bin 57 to push material up and lift same to remove. A photocell 63 is disposed in the bottom 61 for communication with a light source 65 above bin 57 when bin 57 is empty photocell 63 which is connected up in the system's circuit for control purposes. When the control circuit is adjusted to count off a desired number of sets of collated material, less than the desired number of sets may fill bin 57. To avoid filling bin 57 to overflow, cut-off means are provided to stop the system from processing further sets of collated material. After the collated sets of material are removed from bin 57, communication between the light source 65 and photocell 63 will reactivate the circuit to resume processing collated sets of material toward completing the collating of the desired number of sets.

Figure 1:
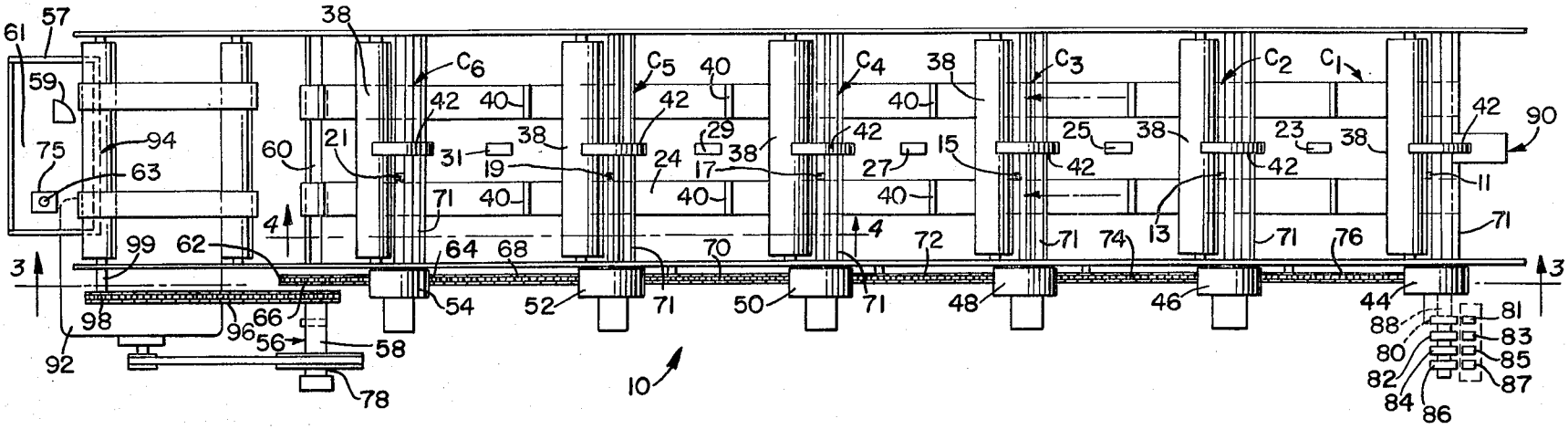
FIG. 1 is a plan view showing the general details of a machine according to the present invention.
Figure 12:
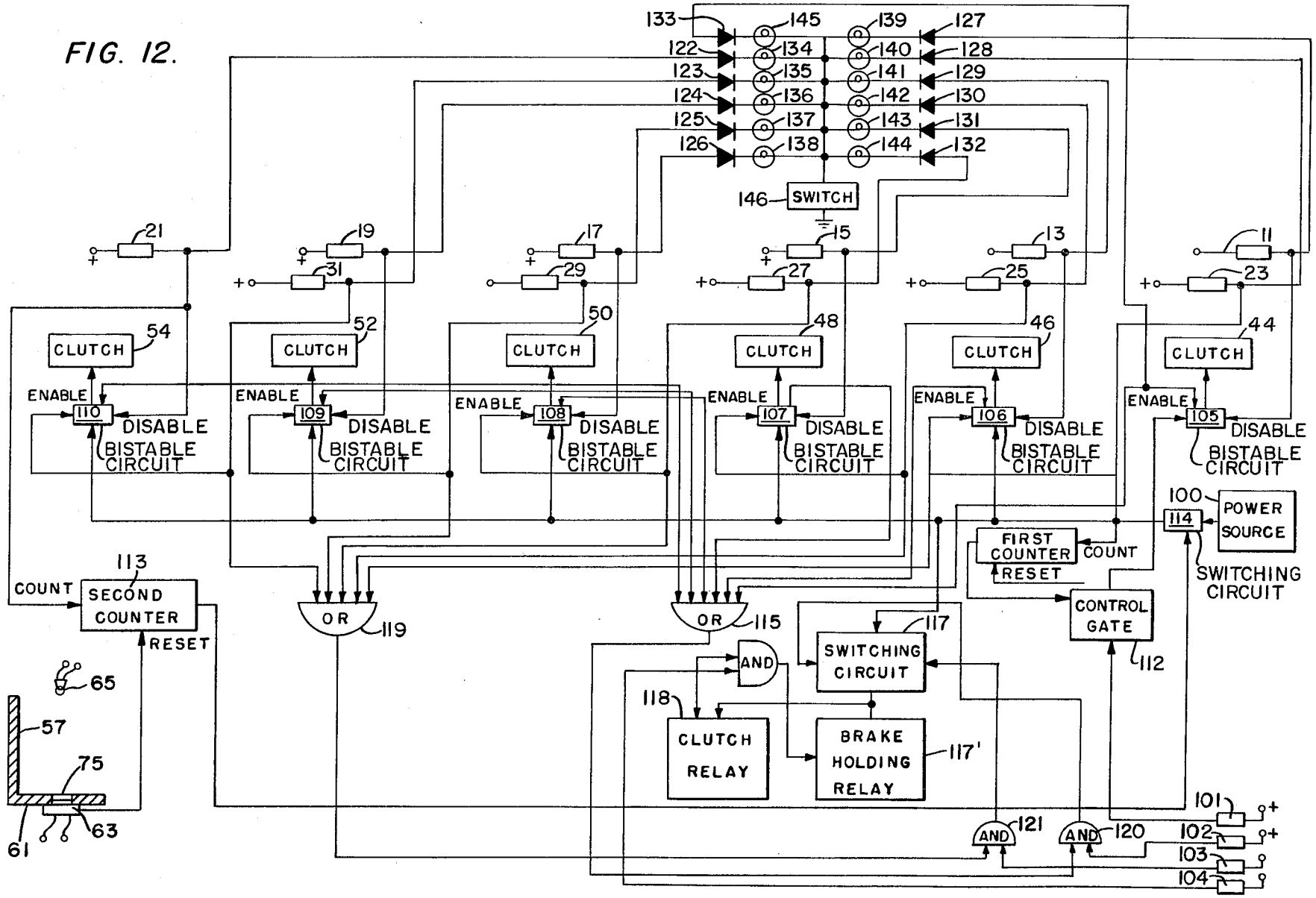
FIG. 12 shows a schematic diagram of electrical circuitry for carrying forth the present invention.

As illustrated in FIG. 12, an exemplary circuit for operating the collator of FIGS. 1–11 is shown in operative association with the first set of microswitches 11, 13, 15, 17, 19 and 21 and the second set of microswitches 23, 25, 27, 29, 31, which form part of the circuit and whose physical location is best seen in FIG. 1. The circuit includes four diagramatically illustrated switches 101–104 which are operated respectively by the four cam followers 81, 83, 85, 87 which are under the control of the respective four cams 80, 82, 84, 86 attached adjustably to the shaft 88, as best shown in FIG. 1.

The switch 101, upon activation by the cam 80 and the follower 81, supplies an enabling signal to a first bistable switching circuit 105 which supplies power to the electromagnetic clutch 44 from a power supply 100. The clutch 44 becomes engaged and effects rotation of the sheet pullout roller 38 causing a sheet from the first stack at the tray 12 to move past the first microswitch 11 which produces a momentary signal which is fed to the first switching circuit 105 as a disabling signal, causing power feed from the power supply 100 to cease and the electromagnetic clutch 44 to become disengaged. The pull-out roller 38 consequently stops and remains in its stopped position until the shaft 88 is rotated through 360° causing the cam follower 81 again to close the switch 101.

The sheet S which first was moved past the microswitch 11 continues on falling into place at a particular station or compartment $C_1$ of the conveyor 24 which continues to move; as a result, this station is moved beneath the second tray or stack 14 of sheets. After the sheet S fed by the pull-out roller 38 has passed the first microswitch 11, it passes the microswitch 23 which produces an enabling signal which is fed to the second bistable switching circuit 106. The bistable switching circuit 106 supplies power from the power supply 100 to the electromagnetic clutch 46 which becomes engaged and effects rotation of the sheet friction feed wheel 42. The second clutch unit 46 and friction feed wheel 42 causes a sheet S from the second stack 14 of sheets S to move past the microswitch 13 on its passage to the particular station $C_2$ on the conveyor 24 which already holds the first-fed sheet S. The microswitch 13 produces, as the sheet passes over it, a disabling signal which is fed to the switching circuit 106. The switching circuit 106 returns to its initial state, the power supply 100 is disconnected from the electromagnetic clutch 46 and it becomes disengaged, remaining so until receipt of a further enabling signal from the microswitch 11.

As the conveyor 24 moves along, the microswitches 25, 27, 29, 31 enable, in succession, bistable switching circuits 107–110, respectively, and the microswitches 15, 17, 19, 21 disable the switching circuits 107–110, respectively, again in succession.

A first settable counter 111 having its count input connected to the microswitch 11 is initially set by an operator to count up to a given number which corresponds to the number of sets which are to be collated during a particular run. As pointed out above, the microswitch 11 is tripped once for each bottom-most sheet of the sets to be completed. The counter 111 responds to the individual signals received from the microswitch 11 and produces a control signal upon reaching the count number selected by the operator which is fed to a control gate 112. The controlled gate 112, which is in the feed path between the switch 101 and the first switching circuit 105, opens as a result the electromagnetic clutch 44 is no longer energized during the current run with the result that the electromagnetic clutches 46, 48, 50,

52, 54 become successively finally disengaged for this run, after feeding respectively one to five additional sheets. Each set of sheets produced by the collator 10 is thus complete, no incomplete sets being produced either initially or left on the conveyor 24.

The circuit also includes a second settable counter 113 which, like the counter 111, is set by an operator to count up to a given number which corresponds to the maximum number of sets which can be held in the box or bin 57 during the run in question. The count input terminal of the second counter 113 is connected to the microswitch 21 which is tripped once for each top sheet of the sets as these sheets pass over the microswitch 21. Upon reaching the selected count, the second counter 113 produces a control signal which is fed to a switching circuit 114 which interrupts the feed of power to the brake 90, the motor 92 and to the switching circuits 105–109, as well as other circuitry.

The conveyor 24 thus is stopped until an operator removes the stack of sets in the bin 57. As a result, light from the light source 65 impinges on the light detector 63, via the hole 75 in the bottom of the bin 57, which produces an output signal which is fed to the reset terminal of the second counter 113. The switching circuit 114 is again switched ON and the machine repeats the cycle described above until the bin 57 is filled to a predetermined level short of overflowing.

In the event a sheet fails to be fed from any of the six stacks, because of the fact that the station in question is jammed or empty or for any reason, one of the microswitches 23, 25, 27, 29, 31, depending on the stack involved will fail to produce a signal to enable the next in line of the bistable switching circuits 106–110 and fail to produce a disable signal for its associated bistable switching circuit or, in the case of the microswitch 31', a signal indicative of the passing of the final sheet of a set.

As shown, each of the bistable switching circuits 105–110 produce a respective individual output signal when they are enabled, these signals being fed to a six-input OR circuit 115 whose output is supplied to a first input of an AND circuit 116 which has its second input connected to the switch 104. The switch 104 is controlled by the cam follower 87 which is associated with the fourth cam 86 attached to the shaft 88. The fourth cam 86 has its camming surface, which closes the switch 104, circumferentially located, with respect to the camming surface of the first cam 80, at the 300° to 320° segment. Thus, the switch 104 is closed once each turn of the shaft 88 and produces an output signal at a particular time after it is expected a sheet S has been fed from each of the tray 12, 14, 16, 18, 20, 22. In the event a sheet has not been fed from any particular stack, a corresponding input signal will apear on one of the inputs to the OR gate 115 and be passed on to the first input of the AND gate 116. If such a signal is present at the same time the signal from the switch 104 appears on the other input of the AND gate 116, the AND gate 116 produces an output signal which is fed as an enabling control signal to a switching circuit 117 which supplies power from the power source 100 to the brake holding relay 117' and the conveyor clutch relay 118 which stop respectively rotation of the shaft 88 and movement of the conveyor which becomes decoupled from the motor 92. The particular friction feed wheel 42 at the station which failed to feed a sheet continues to rotate. All other friction feed wheels 42 are stationary; consequently, the operator can see which station failed to feed. He can then simply unjam the sheets waiting to be fed from that particular station or refill the corresponding tray if it is empty. The result is that a heretofore missing sheet is fed from the correct station, the error-indicating input to the OR gate 115 disappears when the sheet passes over whichever one of the microswitches 23, 25, 27, 29, 31 which had failed to sense a passing sheet earlier. The enabling output from the AND gate 116 is effectively removed and the switching circuit 117 opens so that the brake holding relay 117' releases the brake 90, the clutch relay 118 engages the conveyor clutch, and the collator returns to normal operation. The sheets from the various stacks again are one after another placed on the compartmentalized section of the conveyor 24 until both the counters 111 and 113 both produce their respective output signals which result in the sheet count of the collator in the manner set out above.

As thus far described, the circuit of FIG. 12 effects control of the collator illustrated FIGS. 1–11, the entire system being synchronized by the rotating shaft which carries the adjustable cams 80, 82, 84, 86. The circuit also, as pointed out above, responds to a failure to feed from any of the six trays 12, 14, 16, 18, 20, 22 of sheets S in such a manner that the station at which the failure occurred is easily identified and the collator readily placed back into operation without any incomplete set being formed or a need to start initial feeding from the first stack.

During operation, it is possible that a sheet from one or the other of the six stacks will be fed either too early or too late for assuring its correct position on a set being carried along on the conveyor 24. The circuit of FIG. 12 is arranged to effectively stop the collator conveyor 24 whenever a sheet S is fed too soon or too late, operating faults which can occur for a number of reasons, for example, when the gap between one of pull-out rollers 38 and one or another of the stacks 12, 14, 16, 18, 20, 22 is not well adjusted or one sheet S partially pulls along a second sheet S.

Also, a five-input OR gate 119 is provided with inputs connected respectively to the outputs from the feed-responsive microswitches 23, 25, 27, 29, 31. Thus, whenever any of the microswitches 23, 25, 27, 29, 31 sense the passing of a sheet, an output appears from the OR circuit 119 which is fed respectively to first inputs of a pair of AND circuits 120 and 121. The second input of the AND circuit 120 is supplied from the switch 102 which is activated by the cam follower 83 which rides on the cam 82, the switch 102 supplying an output signal during the 10° to 30° segment of the rotation of the shaft 88. The second input to the AND gate 121 is supplied from the switch 103 which is activated by the cam follower 85 which rides on the cam 84, the switch supplying an output signal during the 100° to 120° segment of rotation of the shaft 88. Thus, if any one of the microswitches 23, 25, 27, 29, 31 senses the presence of a sheet during the periods the switch 102 or the switch 103 produces a signal, the sheet is being fed too early or too late, the AND circuit 120 produces an output signal which is fed to the switching circuit 117 causing it to open the circuit supplying power to the conveyor clutch relay 118 and the brake holding relay 117'. As a result, the collator stops. The AND circuit 121 similarly produces a control signal whenever the microswitches 23, 25, 27, 29 31 sense a feed of a sheet from any of the six stacks 12, 14, 16, 18, 20, 22 of sheets S which is too late. This control signal is fed to the switching circuit 117 which closes the switching circuit 117, causing the brake 90 to engage by energizing the brake holding relay 117′ and the conveyor clutch 78 to disengage by deenergizing the clutch relay 118.

In order for an operator to determine easily which station has experienced a misfeed; that is, either too late a feed or too early a feed, possibly a double feed, an output from each of the microswitches 11, 13, 15, 17, 19, 21 and 23, 25, 27, 29, 31 is fed, via individual diodes 122-132, to individual lights 134–145. The lights 134–145 are connected to a point of reference potential (ground) via a common switch 145 which is controlled by the switching circuit 117. Whenever the switching circuit 117 energizes the clutch relay 118 and the brake holding relay 117′, it additionally closes the switch 146 causing current to flow through any one of the lights 134–145 which is coupled, via a corresponding one of the diodes 122–132, to a source of positive potential by virtue of one or another of the microswitches being closed. Consequently, whenever a sheet is fed too late or too early, the switching circuit not only effects the stopping of the conveyor 24, but also causes a light to be energized so that the operator may known from which tray the misfeed has occurred and if a too late or too early feed has taken place.

It is to be appreciated that auxiliary switches may be provided for turning on or resetting the bistate switching circuit 106–110. In some installations, additional lights, with additional series connected diodes, and an additional common switch could be operatively associated with the microswitches 11, 13, 15, 17, 19, 21 and other circuit components to provide a visual indication of a failure to feed. Of course, since a failure to feed results in a continuous running of that friction feed wheel 42 which did not effect a feed, with a shut down of all others, this circuitry is not necessary.

FIG. 5 shows the collating conveyor 41 with a sixth sheet S being deposited at $C_6$ after having passed stations $C_5$, $C_4$, $C_3$, $C_2$ and $C_1$ and received one sheet from each. At the same time sheets number five, four, three, two, and one are shown to be deposited on conveyor 41 at stations $C_5$, $C_4$, $C_3$, $C_2$ and $C_1$ after each had passed and received one sheet from each previous station except in the case of $C_1$ at which a first sheet is being deposited on the conveyor 41.

It will be obvious to those skilled in the art that various changes may be made without departing from the scope of the invention and the invention is not to be considered limited to what is shown in the drawings and described in the specification.

What is claimed is:

1. A machine for collating sheet material from a plurality of individual groups to form sets including one sheet from each of said group comprising, in combination:

a. a plurality of spaced-apart slanted trays each of which is adapted to support stacks of identical sheets of different ones of said groups;

b. endless collating conveyor means having an upper run moving under said trays;

c. feeding means adjacent each of said trays for pulling out a sheet from the tray adjacent thereto and depositing it onto said collating conveyor means, each of said feeding means including a pull-out roller, a drive wheel in frictional drive relationship with said pull-out roller, a paper separator member supported adjacent the lower edge of the tray adjacent thereto in frictional contact against said drive wheel, and a drive shaft secured to said drive wheel and having an electrically actuated clutch on one end thereof;

d. transmission means adapted to be engaged with the clutch of each of said feeding means to effect driving relationship between the drive roller and the pull-out roller thereof;

e. first switch means disposed downstream relative to the travel of said endless conveyor from each of said tray and feeding means for supplying electrical current to disengage the clutch of the feeding means upstream thereof in response to sheet material fed out from the tray immediately upstream thereof;

f. second switch means disposed upstream from all except the first of said trays and feeding means for supplying electrical current to engage the clutch of the feeding means immediately downstream therefrom in response to sheet material fed out from the tray immediately upstream therefrom;

g. a common power shaft supplying power to said transmission means and said collating conveyor means;

h. an electrically actuated system clutch for connecting said power shaft to said transmission means and said collating conveyor means;

i. electrically actuated brake means for stopping said collating conveyor means; and j. control means including a first rotary cam and switch for supplying electrical current to engage the clutch of the first feeding means and first tray to initiate one or more operational cycles of said machine and additional rotary cam and switch for supplying electrical current to disengage said system clutch and to engage said brake means upon failure of a sheet to be fed past any one of said first switch means which is downstream from its tray to disengage the clutch of the feeding means associated therewith.

2. The machine as claimed in claim 1 wherein said collating conveyor means comprises a plurality of longitudinally spaced-apart, radially extending partitions defining individual compartments into which one sheet from each of said trays is to be deposited as said conveyor means passes under said trays.

3. The machine as claimed in claim 2 wherein said power shaft includes gear means secured thereto and in driving relationship with said endless collating conveyor means.

4. The machine as claimed in claim 3 wherein an additional shaft with additional gear means secured thereon are spaced apart from said power shaft and in driving relationship with said endless collating conveyor means.

5. The machine as claimed in claim 4 wherein said brake means includes a portion secured to said additional shaft and further said control means are at least in part mounted on said additional shaft.

6. The machine as claimed in claim 5 comprising in combination therewith electrical circuit means for supplying electrical current to apply said brake means to stop said collating conveyor means subsequent to continued driving relationship between the pull-out roller and the drive wheel of any of said trays due to continued engagement of the clutch associated therewith from failure of a single sheet or page passing the first switch means downstream from the tray adjacent thereto.

7. The machine as defined in claim 2 wherein said collating conveyor means comprises a plurality of links some of which are each provided with an L-shaped plate forming one of said radially outwardly extending partitions.

8. The machine as defined in claim 7 wherein those of said links provided with one of said L-shape plate also include slot means through which a portion of said one of said L-shape plate extends and is securely retained therein so as not to be dislodged therefrom.

9. The machine as defined in claim 8 wherein a first deflector plate is disposed at the downstream end of said conveyor means whereby each of said radially outwardly extending partitions strikes said first deflector plate as it passes around the downstream end of said conveyor means and is thus prevented from catching or tearing collated sheets discharged from said conveyor means.

10. The machine as defined in claim 9 wherein a second deflector plate is disposed adjacent the upstream end of said conveyor means and each of said L-shape plates includes a radially inner portion which strikes said second deflector plate as it passes around the upstream end of said conveyor means whereby each of said radially outwardly extending partitions is raised to an operating position.

11. The machine as defined in claim 10 wherein said slot means in said links are actually a pair of laterally spaced laterally extending slits and each of said L-shape plates include spaced-apart tabs forming the radially inner portion of each of said L-shape plate, said tabs extending through and straddling said pair of slits.

12. The machine as defined in claim 1 wherein a transfer conveyor is disposed downstream from said collating conveyor means and a collection bin is disposed downstream from said transfer conveyor with sets of collated material being temporarily accumulated in said bin, said bin having a hole in the bottom thereof through which a hand may be inserted to lift sets of collated material from said bin.

13. The machine as defined in claim 12 wherein light means and photocell are located adjacent said collection means with one of said light means and photocell disposed above said bin and the other of said light means and photocell disposed in the bottom of said bin and positioned so that said light means and said photocell are in line of sight to each other when said bin is empty.

14. The machine as defined in claim 13 wherein said photocell is provided with means connected thereto for reactuating said machine to continue collating sets of material.

15. The machine as defined in claim 1 wherein each of said trays includes a pair of laterally spaced slotted claw members each of which is supported on a rotatable shaft on which said paper separator member is secured for rotation therewith with said shaft rotatable within said claw members, said claw members being optionally readily removable from said shaft.

16. A control circuit for controlling a machine for collating sheet material which includes a conveyor which moves beneath a plurality of stations, the circuit comprising:

a first plurality of microswitches, each switch of said first plurality being responsive to a sheet leaving a respective stack of sheets;

a second plurality of microswitches, each switch of said second plurality being responsive to a sheet arriving in the vicinity of a station over the moving conveyor;

means for providing signals representative of the position of said moving conveyor with respect to said stations; and circuit means responsive to output from at least one of said first and said second pluralities of microswitches and from said means for providing signals representative of the position of the conveyor for producing a signal indicative of whether a sheet is being fed too early or too late from its representative stack of sheets.

17. A circuit according to claim 16, including means responsive to output from said circuit means for stopping the conveyor upon occurrence of a misfeed.

18. A circuit according to claim 17, including means responsive to a particular sheet count from a final station of said stations for interrupting power to the machine.

19. A circuit according to claim 17, wherein said means responsive to output includes a clutch relay and a brake holding relay.

20. A circuit according to claim 17, including means responsive to signal output conditions of said microswitches and to output from said means for stopping the conveyor for providing a visual signal indicative of misfeed at respective ones of the stations.

21. A circuit according to claim 16, including means responsive to a particular sheet count from a final station of said stations for interrupting power to the machine.

* * * * *